US010124975B2

(12) United States Patent
Retterath et al.

(10) Patent No.: US 10,124,975 B2
(45) Date of Patent: Nov. 13, 2018

(54) METHOD FOR CONVEYING ADHESIVE-SIDED ARTICLES AND APPARATUS FOR DOING SO

(71) Applicant: 3M INNOVATIVE PROPERTIES COMPANY, St. Paul, MN (US)

(72) Inventors: Joshua M. Retterath, Cannon Falls, MN (US); Kevin B. Newhouse, Houlton, WI (US); Bruce E. Tait, Woodbury, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 136 days.

(21) Appl. No.: 15/508,693

(22) PCT Filed: Sep. 4, 2015

(86) PCT No.: PCT/US2015/048511

§ 371 (c)(1),
(2) Date: Mar. 3, 2017

(87) PCT Pub. No.: WO2016/037040

PCT Pub. Date: Mar. 10, 2016

(65) Prior Publication Data

US 2017/0275121 A1 Sep. 28, 2017

Related U.S. Application Data

(60) Provisional application No. 62/046,675, filed on Sep. 5, 2014.

(51) Int. Cl.
*B65H 27/00* (2006.01)
*B65H 20/02* (2006.01)

(52) U.S. Cl.
CPC ..... *B65H 27/00* (2013.01); *B65H 20/02* (2013.01); *B65H 2404/5391* (2013.01); *B65H 2404/56* (2013.01)

(58) Field of Classification Search
CPC ..... B65H 20/02; B65H 27/00
See application file for complete search history.

(56) References Cited

U.S. PATENT DOCUMENTS 3,993,021 A 11/1976 Kline
4,730,778 A 3/1988 Akao
(Continued)

FOREIGN PATENT DOCUMENTS

DE 3842350 6/1990
DE 0723865 7/1996

OTHER PUBLICATIONS

International Search Report for PCT International Application No. PCT/US2015/048511, dated Jan. 29, 2016, 6 pages.

*Primary Examiner* — Michael C McCullough
(74) *Attorney, Agent, or Firm* — Gregory D. Allen

(57) ABSTRACT

A method for conveying a workpiece having a first major surface with exposed adhesive using at least one transport roll (34) having an engagement cover (24) having an engagement surface comprising looped filaments (26) that have a low surface energy wherein the work-piece (10) passes through engaging contact with the engagement surface such that at least a portion of the pressure sensitive adhesive (18) directly contacts the engagement surface wherein the pressure sensitive adhesive (18) is tacky when in contact with the engagement surface. Also an apparatus for carrying out the method.

26 Claims, 8 Drawing Sheets

(56) References Cited

U.S. PATENT DOCUMENTS

| | | | |
|---|---|---|---|
| 6,120,864 | A | 11/2000 | Chiricosta et al. |
| 2010/0064917 | A1 | 3/2010 | Blanchard |
| 2012/0241549 | A1 | 9/2012 | Newhouse |
| 2012/0240370 | A1 | 11/2012 | Newhouse et al. |
| 2014/0008014 | A1 | 1/2014 | Walker |

METHOD FOR CONVEYING ADHESIVE-SIDED ARTICLES AND APPARATUS FOR DOING SO

CROSS REFERENCE TO RELATED APPLICATIONS

This application is a national stage filing under 35 U.S.C. 371 of PCT/US2015/048511, filed Sep. 4, 2015, which claims the benefit of Provisional Application No. 62/046,675, filed Sep. 5, 2014, the disclosure of which is incorporated by reference in its/their entirety herein.

FIELD

The present invention relates to a method for conveying adhesive-sided articles (e.g., flexible webs, rigid articles, etc.), and apparatus for doing so.

BACKGROUND

Many products are often manufactured in a continuous web format for the processing efficiencies and capabilities that can be achieved with that approach. The term "web" is used here to describe thin materials which are manufactured or processed in continuous, flexible strip form. Illustrative examples include thin plastics, paper, textiles, metals, and composites of such materials. Illustrative examples of product components and products that are manufactured in a web format include adhesive tapes, reflective sheeting, optical films, packaging materials, labels, etc.

Such operations typically entail use of one or more, frequently many more, transport rolls (sometimes referred to as rollers) around which the web is conveyed throughout the manufacturing process undergoing a series of treatments, manufacturing steps, etc. Transport rolls are used for many purposes, including, for example, turning the direction of the web, positioning the web for travel through processing stations (e.g., coating and other treatment stations, converting stations, etc.), positioning multiple webs for lamination, stretching webs, etc. Rolls used in such operations are made of a variety of materials, with the selection dependent in large part upon the web(s) being handled, the operational parameters (e.g., speed, temperature, humidity, tension, etc.). Some illustrative examples of materials used to make rollers or covering surfaces thereon for transport of adhesive-sided webs include rubber, plastics, metal (e.g., aluminum, steel, tungsten, etc.).

Many web materials comprise an exposed adhesive layer on at least one side thereof. Conveying adhesive-sided web materials is challenging, particularly when the adhesive is tacky under the conditions in which it is being conveyed as the adhesive tends to stick to the surface of any transport roll it contacts, leading to fouling the roll, interfering with proper web conveyance, and degrading the web. One currently known handling technique is to coat idler rolls with low- or non-stick material. Although this may work satisfactorily for a time, the coating tends to wear off or become fouled and the rolls need to be removed from service and resurfaced, posing significant downtime and fabrication costs. Related approaches include wrapping idler roll with suitable low- or non-stick materials, (e.g., TEFLON™ Tape, TESA® 4563 or 4863 Tape (silicone rubber coated rayon tape), silicone tape, etc.), or applying sleeves of suitable low- or non-stick materials over the idler roll. Such approaches are still subject to undesirable downtime and handling expenses. Another technique is to knurl the surface of an idler roll so as to reduce its area of contact with the adhesive side of the web as it is conveyed past. This approach is typically successful only when using relatively lower tack adhesives. Still another technique is to use a removable protective liner on the adhesive surface during conveying the material. Use of liners necessitates additional material and processing costs.

Many similar challenges and solutions are encountered with conveying rigid articles having exposed adhesive layers.

In order to provide desired end use performance, current trends include the use of pressure sensitive adhesives in relatively thicker coatings, pressure sensitive adhesives that are more aggressively tacky, have lower viscosity, etc. Such adhesive materials are more difficult to handling during manufacturing of the intended adhesive-sided product.

The need exists for improved methods and apparatus for conveying articles having an exposed adhesive layer.

SUMMARY

The present invention provides a novel method for conveying a workpiece having a major surface with exposed adhesive and novel apparatus for carrying out the method. The present invention can be used with a variety of workpieces including long webs as well as sheets or other smaller discrete pieces.

Briefly summarizing, the method of the invention comprises:

(a) providing a workpiece having a first major surface having exposed pressure sensitive adhesive thereon;

(b) providing at least one transport roll having an engagement cover having an engagement surface comprising looped filaments that have a surface energy of less than about 30 dynes/centimeter$^2$;

(c) configuring the workpiece into passing configuration to the transport roll; and (d) passing the workpiece through engaging contact with the engagement surface such that at least a portion of the pressure sensitive adhesive of the first major surface of the workpiece directly contacts the engagement surface wherein the pressure sensitive adhesive is tacky when in contact with the engagement surface.

In brief summary, the apparatus of the invention comprises one or more transport rolls having an engagement cover as described herein.

We have discovered that using such knits as engagement covers on transport rolls achieves an effective limited surface area and contact to an adhesive-bearing face in engaging contact therewith so as to attain desired transport roll effectiveness without expected disadvantages of fouling, degradation of adhesive, etc. Some of the surprising advantages provided by the present invention include significantly reduced manufacturing costs and higher yields. Use of transport rolls with engagement covers as described herein permit longer run times between shutdowns for clean up, permit faster run rates, and eliminate the need for provision, installation, removal, and disposal of release liners. Use of such transport rolls in accordance with the invention permit changing production parameters (e.g., switching adhesive compositions, etc.) with reduced or eliminated retooling, leading to greater manufacturing efficiency and cost reduction.

BRIEF DESCRIPTION OF DRAWING

The invention is further explained with reference to the drawing wherein.

Figure 1:
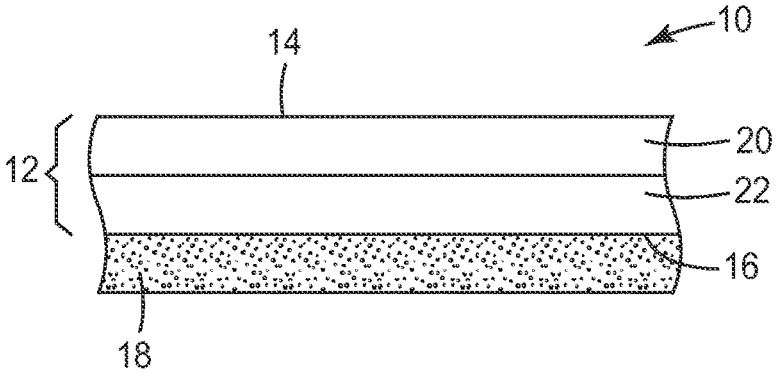
FIG. 1 is a schematic cross section of an illustrative adhesive-sided workpiece with which the invention may be used.

These figures are not to scale and are intended to be merely illustrative and not limiting.

Key and Glossary

The following terms are used herein as having the indicated meaning; other terms are defined elsewhere in the specification.

"Convey" is used to mean moving a workpiece from a first position to a second position wherein the workpiece passes through engaging contact with a roll.

"Engaging contact" is used to refer to contact between the workpiece and the roll such that as the workpiece is conveyed it engages with the engagement cover of the roll compressing the cover in response to contact with the workpiece.

"Engagement surface" is the radially outwardly facing portion of the engagement cover that is directly contacted with the workpiece when the workpiece is conveyed.

"Engagement zone" is the portion of the engagement surface that is in direct contact with the workpiece at a particular moment. Depending upon the configuration, the engagement zone may range from merely substantially tangential contact (e.g., of a rigid workpiece such as an adhesive-coated piece of flooring) to an angular width (e) of up to about 180° (e.g., of a flexible web workpiece that is conveyed around a roll to reverse its direction of movement).

"Resilient" is used to refer to the capability of being deformed or compressed and then recovering to earlier shape or loft.

"Transport roll" is used to refer to a roll used to convey a workpiece and includes rolls which impart minimal if any machine direction impetus to the workpiece (sometimes referred to as idler rolls) and rolls which impart either machine-direction accelerating or decelerating impetus to the workpiece (sometimes referred to as drive rolls).

"Warp knit fabric" is used to refer to a textile or fabric in which the filament or yarn follows a zig-zag interloping path as it is stitched through loops forming adjacent columns called "wales".

"Web" refers to a flexible, elongate ribbon or sheet of material.

"Workpiece" is the item conveyed in accordance with the invention. In typical embodiment, the workpiece will be a flexible web having opposing first and second major surfaces. In some embodiments, the workpiece will be relatively inflexible or rigid (e.g., such as an adhesive-coated piece of flooring such as a tile or laminate plank).

Unless otherwise indicated, all numbers expressing quantities of ingredients, properties such as molecular weight, reaction conditions, and so forth used in the specification and claims are to be understood as being modified in all instances by the term "about". Accordingly, unless indicated to the contrary, the numerical parameters set forth in the foregoing specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviations found in their respective testing measurements.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g., 1 to 5 includes 1, 1.5, 2, 2.75, 3, 3.80, 4, and 5). As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

DETAILED DESCRIPTION OF ILLUSTRATIVE EMBODIMENTS

As described above, the method of the invention comprises, briefly summarizing:

(a) providing a workpiece having a first major surface having exposed pressure sensitive adhesive thereon;

(b) providing at least one transport roll having an engagement cover having an engagement surface comprising looped filaments that have a surface energy of less than about 30 dynes/centimeter$^2$;

(c) configuring the workpiece into passing configuration to the transport roll; and (d) passing the workpiece through engaging contact with the engagement surface such that at least a portion of the pressure sensitive adhesive of the first major surface of the workpiece directly contacts the engagement surface wherein the pressure sensitive adhesive is tacky when in contact with the engagement surface.

The invention may be used with workpieces having a major surface having exposed pressure sensitive adhesive thereon. In many embodiments, the workpiece will be a web having two major surfaces. FIG. 1 shows an illustrative embodiment of a workpiece which is a web material. Web material 10 comprises a sheet 12 having first major surface 16 and second major surfaces 14. First major surface 16 has adhesive 18 thereon. In some embodiments, adhesive 18 may be a substantially continuous layer covering essentially all of first major surface 16 and in other embodiments the adhesive may be in discrete segments in select locations on first major surface 16 (e.g., in ordered, substantially uniform fashion, or in relatively random fashion).

Sheet 12 may be monolayer or multilayer; in the embodiment shown sheet 12 (e.g., a tape backing) comprises first layer 20 and second layer 22 with adhesive 18 thereon.

Figure 2:
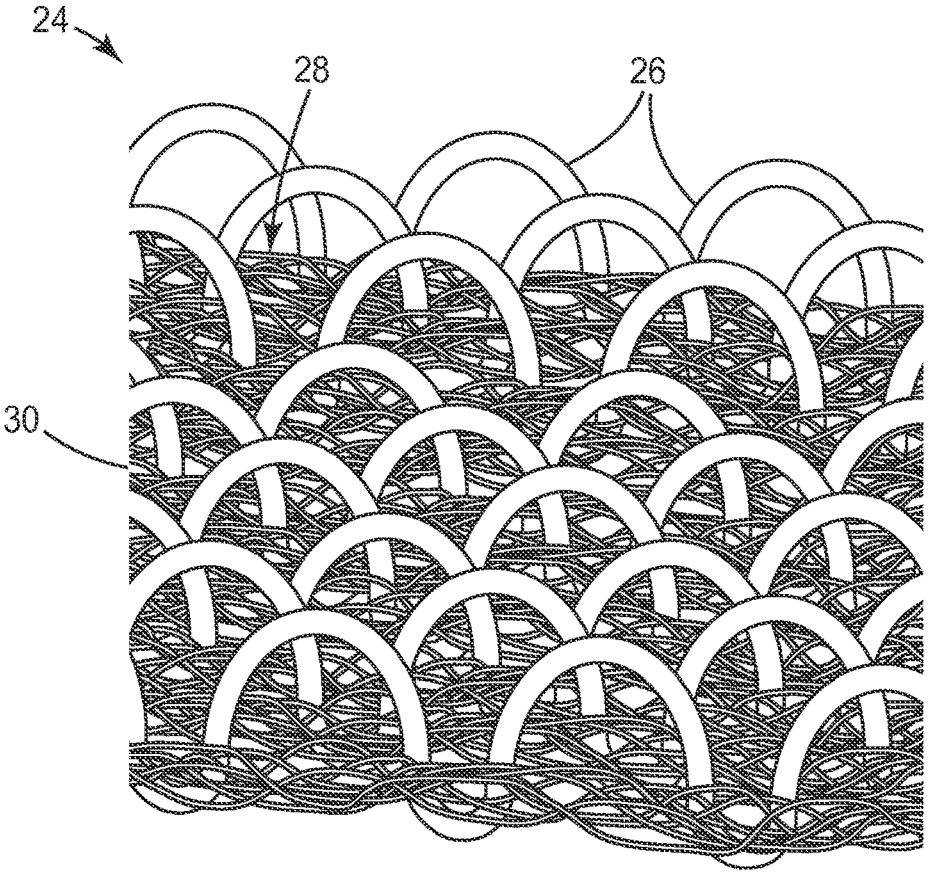
FIG. 2 is a perspective schematic view of a portion of an illustrative embodiment of engagement cover of the invention (jersey knit with terry loop)
Figure 3:
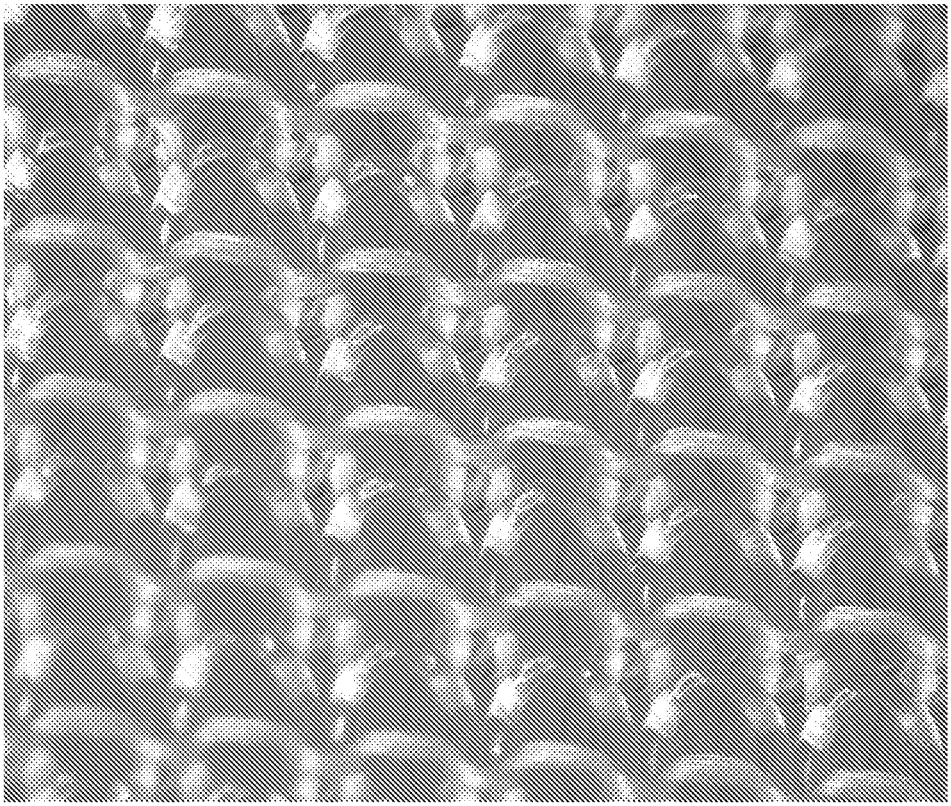
FIG. 3 is a photograph of a portion of an illustrative embodiment of engagement cover of the invention (jersey knit with terry loop)

FIG. 2 shows a portion of an illustrative engagement cover 24 of the invention. Engagement cover 24 comprises a knit with a resilient looped pile made up of filaments 26 protruding from first face 28 of base layer 30. FIG. 3 is a photograph of a portion of such an engagement cover in which loops are visible. Engagement Cover 4 in the Examples is this type of knit. Such engagement covers can be fabricated by stitching filaments 26 into base layer 30 such that the filaments 26 are arranged in an array of protruding loops (i.e., the pile) with portions of filaments 26 between the protruding loop portions being surrounded and supported in position by the surrounding portions (e.g., constituent filaments in this instance) of the layer.

Figure 4:
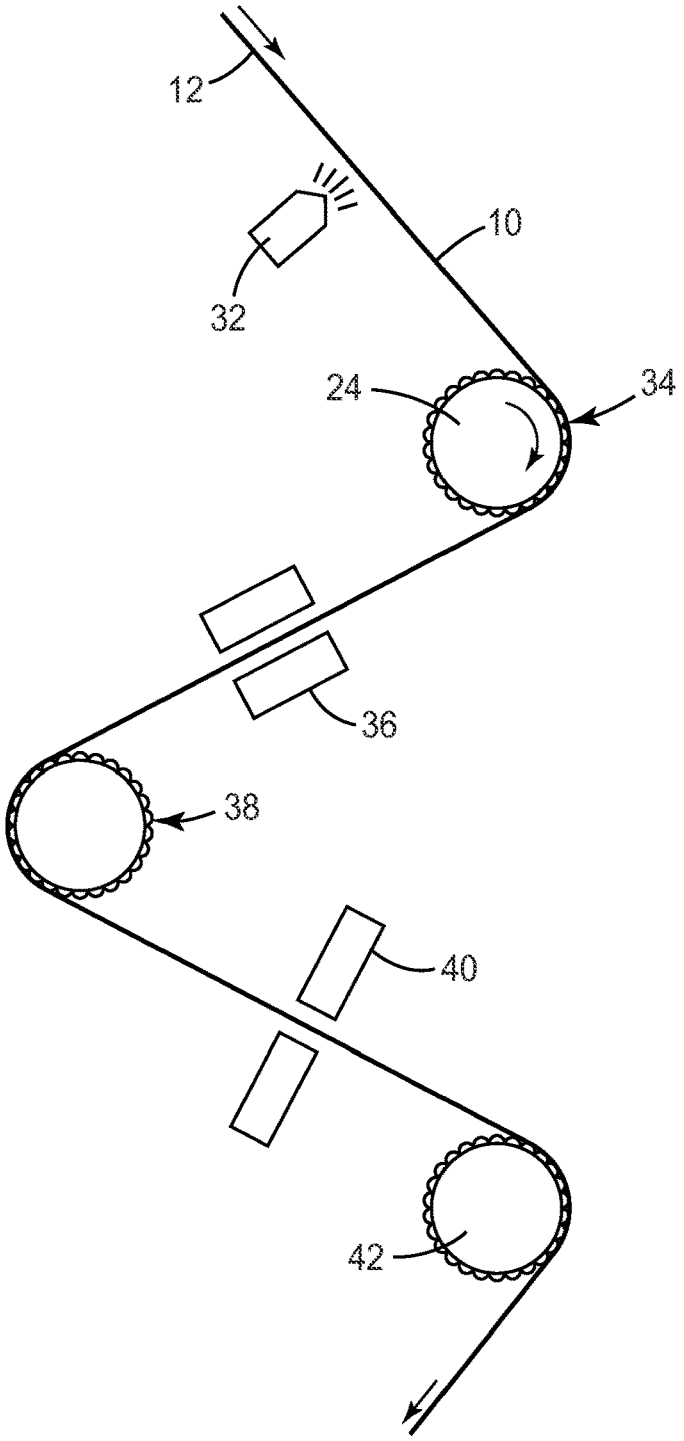
FIG. 4 is schematic diagram of a portion of an illustrative embodiment of an apparatus of the invention.

FIG. 4 shows an illustrative embodiment of the method and apparatus of the invention. In this embodiment, the method begins with sheet 12 (e.g., a tape backing) being provided. At coating station 32 adhesive is coated on first major surface 16 to yield web 10 which is the workpiece in this embodiment. Web 10 is then configured into passing configuration to transport roll 34 having engagement cover 24. In the illustrative embodiment, web 10 is conveyed through engaging contact with engagement cover 24 (in this case changing direction around transport roll 34) to processing station 36, where some other processing is carried out on web 10 (e.g., curing, perforation, application of colorant, etc.), and then toward and around drive roll 38 which contacts the major surface of web 10 opposite the adhesive, toward processing station 40, and then through engaging contact with idler roll 42 which also has an engagement cover of the invention.

In some embodiments, the method of the invention is an integrated operation that is carried out within a larger operation. For instance, the web material may be provided directly from a precursor operation or apparatus (e.g., output from an operation applying adhesive 18 to sheet 12). In other embodiments, the web material may be provided in roll form (e.g., wound upon itself or on a core), optionally with a release liner covering the adhesive; if a release liner is used, it is removed before conveying in accordance with the invention such that the adhesive and engagement cover enter engaging contact. In still other embodiments, the web material may be provided in other configuration if desired (, e.g., a stack or strips or sheets of web material 10).

The present invention may be used with a wide variety of web materials, illustrative examples including plastics, paper, metal, composite films or foils, etc. As will be understood by those skilled in the art, the present invention may be used with other workpieces, including relatively inflexible or rigid articles such as adhesive-coated tiles, laminate flooring planks, etc.

The method and apparatus of the invention may be used with workpieces having a variety of different shapes and configurations. The first major surface of workpieces may be substantially planar, curved in a single axis or dimension (e.g., the rim of a circular workpiece), or more complex with curvature in two or more axes or dimensions (e.g., a workpiece whose first surface is made up with portions having a variety of orientations).

In some embodiments, the web material is provided from an intermediate storage state (e.g., from an inventory of raw materials and/or intermediate materials). In other embodiments, the web material may be provided to the process of the present invention directly from precursor processing (e.g., such as the takeoff feed from a film-forming process). The web material may be single layer or multilayer, in some instances the invention is used to convey the web material through manufacturing operations in one or more additional layers and/or one or more treatments are applied to a web material.

Configuring the web material into passing configuration simply refers to arranging the web material into position and orientation such that it can be put into engaging contact with the engagement surface of a roll in accordance with the invention (i.e., with the adhesive surface making engaging contact with the transport roll). In many embodiments, this will simply comprise unrolling a portion of web material which is in roll form such that it can be put into engaging contact with the engagement surface. In other illustrative embodiments, the web material is formed in a precursor portion of the operation (i.e., in line), and passed directly into a web conveying apparatus of the invention without having been wound into roll form (e.g., the polymeric material is extruded or cast in line to form a film which, at that point is in passing configuration without ever having been wound into roll form) is the web material conveyed by the apparatus of the invention.

Next, the web material is conveyed by the apparatus, passing through engaging contact with the engagement surface of a roll of the invention as doing so. In many embodiments, engagement covers of the invention will be used on idler rolls. In some embodiments, however, engagement covers of the invention may be used on other types of transport rolls, e.g., drive rolls, however such uses are typically avoided because most adhesive layers are not suitable for imparting driving or braking action thereto.

Figure 5:
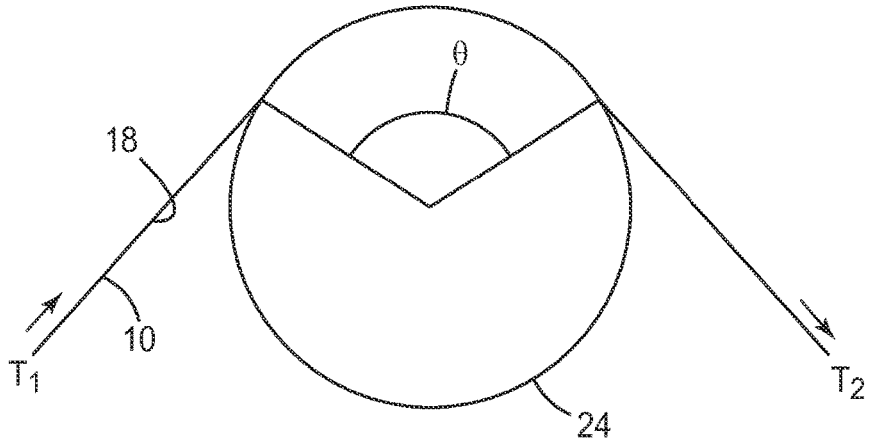
FIG. 5 is a schematic diagram of an illustrative adhesive-sided web in engaging contact with a transport roll in accordance with the invention.

By engaging contact with the roll it is meant that the web contacts the engagement surface of the roll over an arcuate portion referred to as the engagement zone, typically with sufficient pressure such that the looped filaments in the engagement cover are at least partially compressed or that the surface of the adhesive conforms somewhat about the yarn of the engagement surface. As shown in FIG. 5, in accordance with the invention, workpiece 10 with adhesive 18 is configured into passing configuration such that adhesive 18 makes engaging contact with engagement cover 24 on the roll. The engagement zone is that area on the engagement cover where engaging contact is achieved and may be described in geometric terms as the wrap angle, shown here as e. In embodiments were the roll is an idler roll web tension $T_1$ (i.e., on the side approaching the roll) and web tension $T_2$ (i.e., on the side departing the roll after having been conveyed thereby) are substantially equal (i.e., but for possible small variations due to friction in idler roll bearings, etc.), and web speed is the same on both sides of the roll.

The manner in which the engagement cover is mounted on a roll is dependent upon such factors as the configuration of the apparatus and rolls (e.g., in some instances a roll must be removed from its operational location in order to have an engagement cover mounted thereon whereas in other instances the cover can be installed with the roll in operating position).

During operation, the engagement cover should not slide or stretch on the underlying transport roll as this can lead to wear of various components of the apparatus, damage to the web, or other impairment of performance. In many instances, when the engagement cover is simply a knit fabric as described herein and has a snug fit to the surface of the underlying roll, the second face of the engagement cover will remain firmly positioned on the roll during operation. In some instances, mounting means such as an intermediate adhesive, mated hook and loop fasteners, rigid shell which attaches to the roll, etc. will be used. In some instances, multiple engagement covers of the invention are installed on a single roll, mounted concentrically on the roll with the engagement surface of each orientated outward or away from the roll.

In preferred embodiments, the engagement cover is knit fabric as described herein which is mounted on the roll as a removable sleeve. The sleeve is preferably seamless and should be of appropriate size to fit around roll snugly without developing any loose bulges or ridges. In many embodiments, the sleeve will be configured to extend beyond both ends of the roll sufficiently far that it can be cinched and tied; if the sleeve is of appropriate dimension this action typically tends to pull the sleeve tight. Typically the sleeve should be at least as wide as the web, preferably wider than the web to ease concerns about alignment of the traveling web.

Mounting the engagement cover on the roll may be achieved by conventional means dependent in part upon the nature of the engagement cover and that of the conveying apparatus. Preferably the engagement cover does not slide on the roll core during operation. In many embodiments, the cover is in the form of a sleeve that fits snugly on the roll, optionally extending beyond the ends of the roll sufficiently to be cinched there. In some embodiments, the engagement cover and surface of the roll exhibit sufficient frictional effect, in some instances additional means such as adhesive or hook and loop type fastener mechanisms may be used.

While it is typically desirable for the base of a sleeve of the invention to stretch so as to achieve a snug fit on the roll, the base should not stretch during operation so as to cause bunching underneath the web being conveyed.

Alternatively, rolls may be manufactured with engagement covers as described herein being more strongly attached to the outer surface thereof.

An advantage of removable embodiments is that it will typically be easier and cheaper to replace removable engagement covers on a roll to replace the engagement surface of rather than refinishing a roll having an integrated engagement surface in accordance with the invention.

Typically it is preferred that the engagement cover is a knit material. Such fabrics typically exhibit a degree of flexibility and elasticity that reduces or even eliminates undesired impact upon the adhesive surface being conveyed therepast.

Illustrative examples of suitable knit types include the group of warp knits and weft knits. Illustrative examples of knit stitch types useful herein include terry loop knits and French cross knits.

In many embodiments, the engagement cover is a removable sleeve on the roll. Circular knits of suitable size can be manufactured to accommodate a variety of transport rolls.

In some embodiments, it is preferred that the looped filaments comprise monofilament yarn. The homogeneous properties of such materials make them suitable for longer operating lives (e.g., as the filaments wear, the performance characteristics of the cover will more typically remain relatively constant). It will be understood, however, that coated filaments may be used in accordance with the invention.

In many embodiments the filaments will be relatively cylindrical in shape (e.g., with a substantially circular cross section), however the stresses of knitting manufacture and fabrication into the form of an engagement cover may cause portions of the filaments to change shape (e.g., to compress in a dimension so as to result in a relatively more ovate shape). In addition, filaments having other initial shapes may be used, such as trilobal, square, oval, etc.

In some embodiments, the knit consists essentially of monofilament yarn having a surface energy as described herein. Illustrative examples include jersey knit, jersey knit with terry loop, warp knit full tricot (sometimes called a French cross), warp knit chain stitch, warp knit chain stitch with diamond repeat, and lacoste knit.

Typically the yarn filaments have an average diameter of from about 75 to about 1530 micrometers (about 3 to about 50 mils), typically preferably from about 125 to about 510 micrometers (about 5 to about 20 mils) as such filaments are more amenable to knitting.

In many embodiments, the ratio of the average diameter of the yarn in the adhesive contacting pile (of pile/ground embodiments) or adhesive contacting ground (of pile-less embodiments) is at least 1.2 times the average thickness of the pressure sensitive adhesive. In some embodiments the average diameter of the yarn is about 2 to about 30 times the average thickness of the adhesive. Yarns having diameters of different relative dimension to the average thickness of the pressure sensitive adhesive may be used. Typically, it will be preferred to use yams of relatively larger relative dimension with adhesives having lower viscosity (i.e., which will exhibit greater tendency to flow).

Knitting with yarns of relatively greater diameters may be more difficult. In addition to the desired relatively low surface energy characteristics, it is preferred that the yarn filaments be capable of being knit substantially without formation of melt fracture or other surface roughness features. Smoother yarn surface is preferable to minimize the tendency of the tacky pressure sensitive adhesive to wet out the surface of the filaments.

Typically, the knit has an average thread count in the range of from about 6 to about 12 needles/centimeter (about 15 to about 30 needles/inch), and in some instances in the range of from about 8 to about 11 needles/centimeter (about 20 to about 28 needles/inch).

In some embodiments, the knit is made such that the loops in the knit have a radial spacing of from about 1000 to about 1250 micrometers)about 40 to about 50 mils). In some embodiments, the knit is made such that the loops in the knit have an axial spacing of from about 1140 to about 1400 micrometers (about 45 to about 55 mils).

Illustrative embodiments of engagement covers of the invention have been made consisting essentially of French cross knits (i.e., all ground or base material) circular knit into cylinders, namely:

- 3 inch diameter, 80 ends of 1 millimeter (mm) silicone monofilament, non-post cure 60 Shore talcum coated;
- 4 inch diameter, 120 ends of 1 millimeter (mm) silicone monofilament, non-post cure 60 Shore talcum coated;
- 5 inch diameter, 144 ends of 1 millimeter (mm) silicone monofilament, non-post cure 60 Shore talcum coated; and
- 6 inch diameter, 160 ends of 1 millimeter (mm) silicone monofilament, non-post cure 60 Shore talcum coated.

Figure 6:
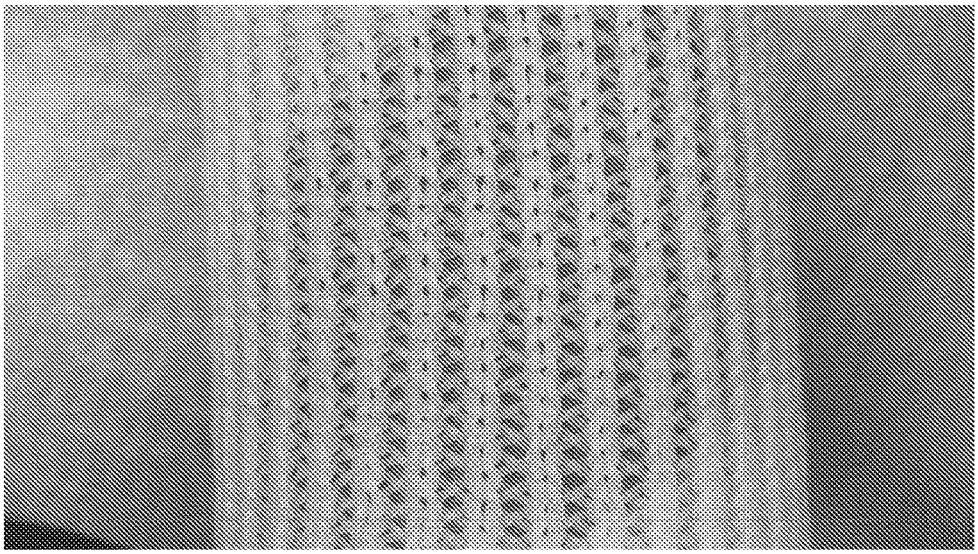
FIG. 6 is a photograph of a portion of one side of an illustrative engagement cover of the invention (warp knit tricot, also referred to as a French cross knit)
Figure 7:
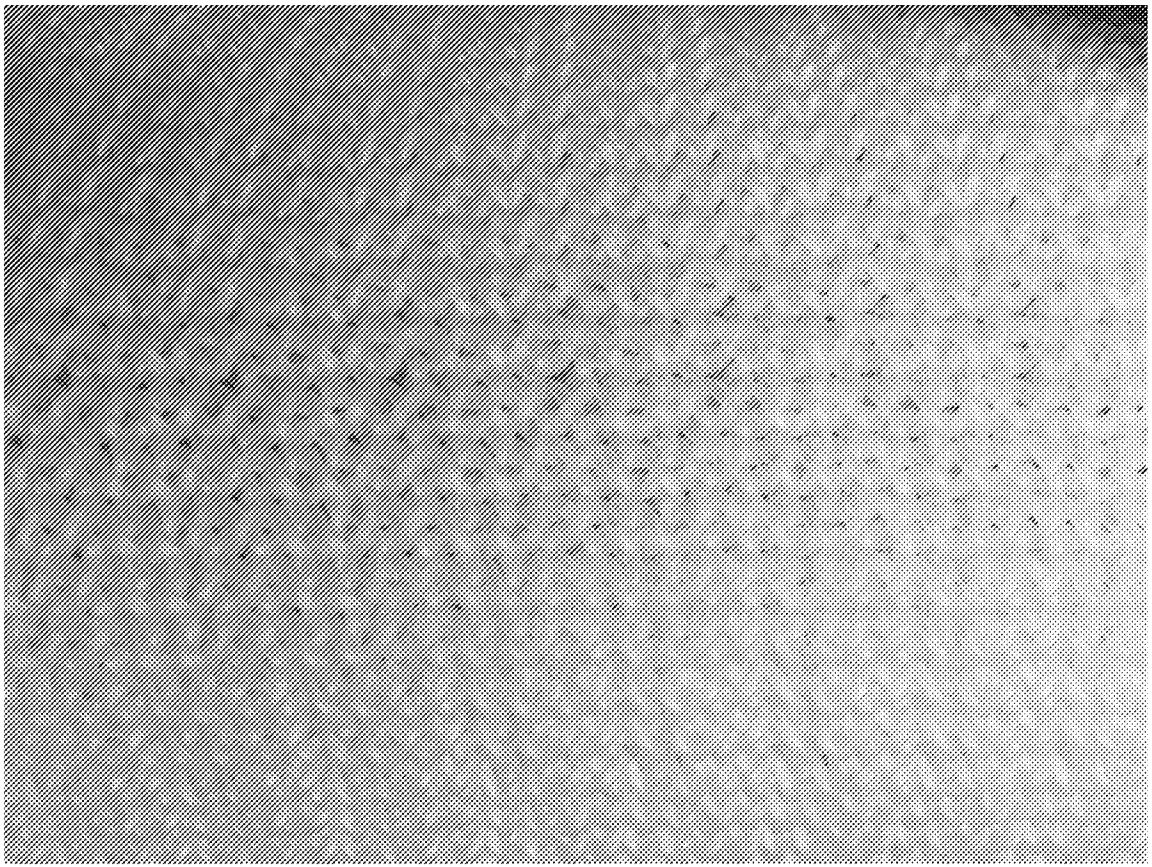
FIG. 7 is a photograph of a portion of the other side of the engagement cover shown in FIG. 6.
Figure 8:
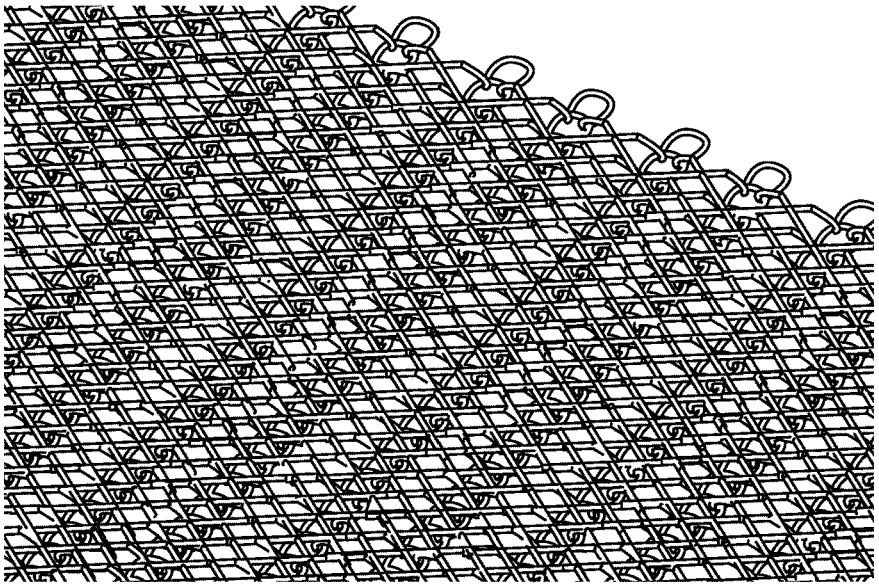
FIG. 8 is a schematic diagram of a portion of an illustrative French knit suitable for use as an engagement cover of the invention.

FIG. 6 shows a portion of an illustrative embodiment of an engagement cover of such knit type on a roll. FIG. 7 shows a portion of an illustrative embodiment of an engagement cover on a roll wherein the same knit type is used but with the other surface of the knit oriented toward the roll (and somewhat lesser degree of stretching). An advantage of warp knit tricot or French knits is that either side possesses looped filaments, typically either side can be used as the workpiece-facing side of an engagement cover in accordance with the present invention. FIG. 8 is a drawing of a portions of an illustrative embodiment of a French cross knit which may be used as an engagement cover of the invention, viewed from the same side as the photograph in FIG. 7.

Illustrative embodiments of engagement covers of the invention have been made comprising fluoropolymer monofilament loops in base or ground stitch layers (e.g., as illustrated in FIG. 2), namely:

- 3 inch diameter circular knit fabric made with 0.008 inch diameter fluorinated ethylene propylene monofilaments as pile loops in 200 Denier TEFLON® yarn with 1.5 mm sinker height;
- 4 inch diameter circular knit fabric made with 0.008 inch diameter fluorinated ethylene propylene monofilaments as pile loops in 200 Denier TEFLON® yarn with 1.5 mm sinker height;
- 5 inch diameter circular knit fabric made with 0.011 inch diameter fluorinated ethylene propylene monofilaments as pile loops in 200 Denier TEFLON® yarn with 1.5 mm sinker height;
- 6 inch diameter circular knit fabric made with 18 ends of 0.011 inch diameter fluorinated ethylene propylene monofilaments as pile loops in 200 Denier TEFLON® yarn with 1.5 mm sinker height;
- 3 inch diameter circular knit fabric made with 0.008 inch diameter fluorinated ethylene propylene monofilaments as pile loops in 100 Denier DYNEEMA® SK-75 Fiber yarn with 1.5 mm sinker height;
- 4 inch diameter circular knit fabric made with 0.008 inch diameter fluorinated ethylene propylene monofilaments as pile loops in 100 Denier DYNEEMA® SK-75 Fiber yarn with 1.5 mm sinker height;
- 5 inch diameter circular knit fabric made with 0.011 inch diameter fluorinated ethylene propylene monofilaments as pile loops in 100 Denier DYNEEMA® SK-75 Fiber yarn with 1.5 mm sinker height; and
- 6 inch diameter circular knit fabric made with 0.011 inch diameter fluorinated ethylene propylene monofilaments as pile loops in 100 Denier DYNEEMA® SK-75 Fiber yarn with 1.5 mm sinker height.

To achieve desired low interaction of the engagement surface with the adhesive, the knit typically comprises yarn selected from the group consisting of silicones and fluoroethylene polypropylenes. Yarns having a surface energy of from about 8 to about 25 dynes/centimeter$^2$ are typically useful. Selection of suitable yarns for a particular embodiment will be dependent in part upon the nature of the adhesive formulation used. For example, silicone-based yarns are typically useful when used with articles sided with acrylic pressure sensitive adhesive. Yarns comprising high molecular weight fluorpolymers can be used with articles having a variety of adhesive formulations (e.g., rubber-based PSAs, silicone-based PSAs, PSAs typically used with duct tape, PSAs typically used with medical tapes (e.g., low viscosity silicone-based adhesives)), etc.

In illustrative embodiments, the fibrous material(s) are selected from the group consisting of poly(tetrafluoroethylene) (PTFE such as, e.g., TEFLON® fiber), aramid (e.g., KEVLAR®), polyester, polypropylene, nylon, or combinations thereof. Those skilled in the art will be able to readily select other fibers which can be effectively knit and used in covers of the invention.

The base is typically knit so as to provide the desired properties to permit it to be placed on a roll and used in accordance with the invention (e.g., stretch and slide sufficiently easily over the roll to permit it to be installed while not stretching undesirably during operation).

Figure 9:
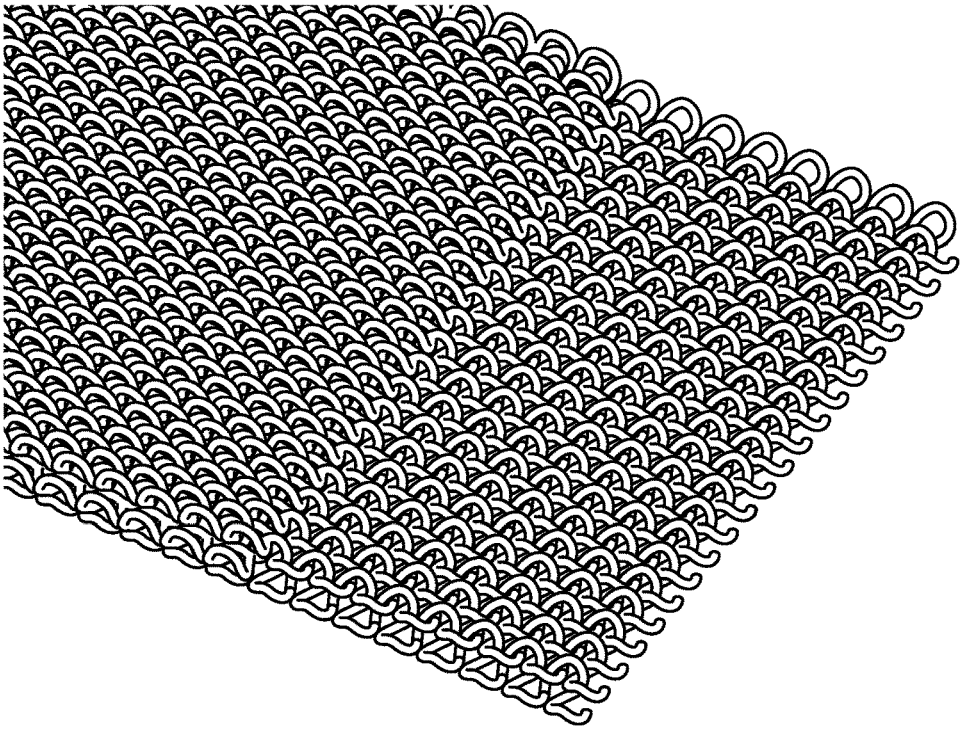
FIG. 9 is a schematic diagram of a portion of an illustrative terry loop knit suitable for use as an engagement cover of the invention (warp knit chain stitch diamond repeat)

FIG. 9 shows a jersey knit in which a first portion (to the right in the view) is simply a jersey knit with a monofilament yarn in accordance with the invention and the second portion (to the left in the view) is that jersey knit with a full pile terry loop knit into the jersey base or ground.

Figure 10:
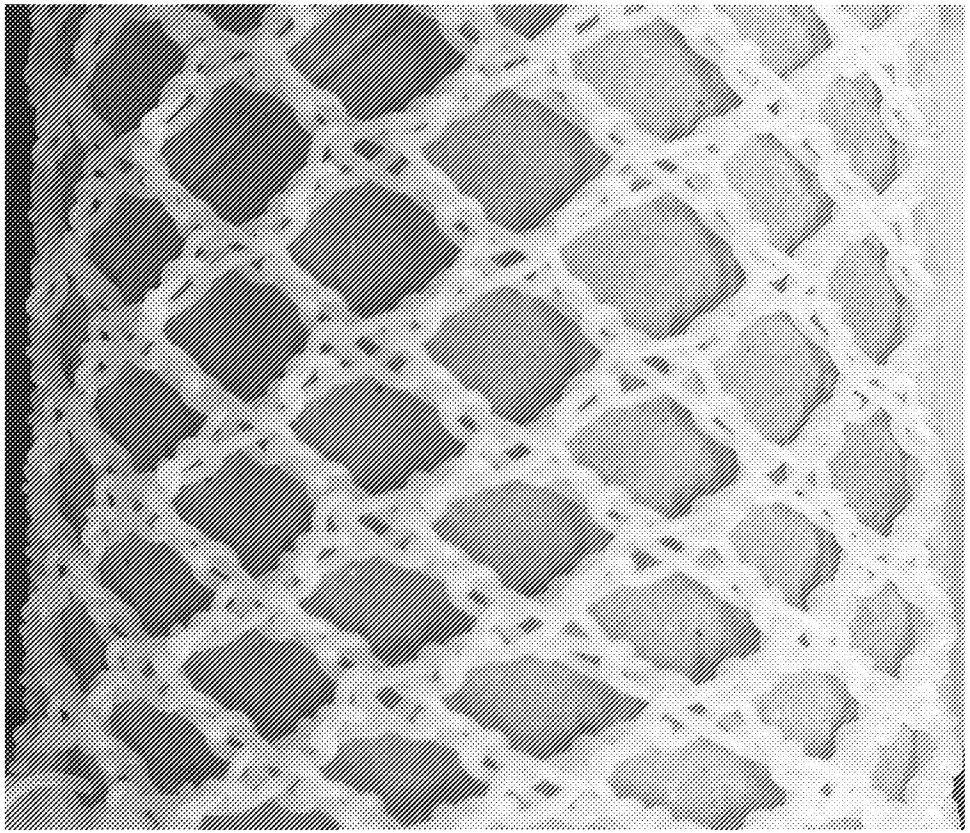
FIG. 10 is a photomicrograph of a portion of a knit material for use as an engagement cover of the invention.

FIG. 10 shows another illustrative knit that may be used as an engagement cover in accordance with the invention. This knit is a warp knit chain stitch with diamond repeating pattern. Engagement Cover 3 in the Examples is this type of knit.

Typically, because of the requirements of the knitting processes used to make them, knit fabrics are made with fibrous materials that have limited elastomeric character so that the fibers can be moved around in contact with one another to form the desired weave. In many instances, lubricants are applied to the fibers to facilitate the knitting process. It is preferred to remove such lubricants from knits used in the present invention (e.g., by cleaning or scouring the material such as by washing) before use. In some instances, the knit can be put into service as an engagement surface of the invention with a lubricant being worn away.

The invention may be used on web transport apparatus having just one or two rolls, or systems having many more rolls. Covers of the invention may be used on one or two selected rolls in a system or in many rolls throughout the system as desired.

The manufacturing operation may include formation of the web, then treatment of the web (e.g., application of primers, additional optical layers, adhesives, colorants, etc.). The present invention provides means for carrying out such operations in a technically effective, cost efficient manner.

EXAMPLES

The invention may be further understood with reference to the following illustrative examples.

Case Studies

Three case studies were conducted in which engagement covers in accordance with the present invention were used in place of conventional engagement covers of the prior art. The results were as follows:

Case Study 1: In a manufacturing setting where conventional (e.g., TESA® tape wrapped) transport rolls failed in about one month, equivalent rolls equipped with engagement covers in accordance with the present invention were operated under similar conditions (i.e., adhesive formulation and thickness of adhesive-sided workpiece, operating speed, etc.) for over six months with no failure.

Case Study 2: In a manufacturing setting where conventional (e.g., TESA® tape wrapped) transport rolls failed in about one week, equivalent rolls equipped with engagement covers in accordance with the present invention were operated under similar conditions for over nine months with no failure.

Case Study 3: In a manufacturing setting where conventional transport rolls failed one to two times per week, equivalent rolls equipped with engagement covers in accordance with the present invention were operated under similar conditions for several times longer with no failure.

Experiments

Experiments were carried out to evaluate certain aspects of the interaction between an engagement cover of the invention with an adhesive-coated workpiece as compared to the interaction of conventional engagement covers with such workpieces under similar conditions.

Workpieces: Three commercial adhesive tapes were used as workpieces as described in the following table.

TABLE 1

| Workpieces | | | | | |
|---|---|---|---|---|---|
| | Adhesive | Thickness (mm) | | | Adhesion to Steel |
| Tape | Type | Total Tape | Backing | Adhesive | (g/cm width) |
| 3M ® Vinyl 471 | Rubber | 0.132 | 0.104 | 0.028 | 257 |
| Scotch ® Packaging Tape 3750 | Synthetic Rubber | 0.079 | 0.028 | 0.051 | 614.0 |
| Scotch ® Filament Tape 893 | Synthetic Rubber | 0.079 | 0.028 | 0.051 | 614.0 |

Engagement Covers: A variety of engagement covers as described in Table 2 were used in the Experiments. Engagement covers 1-11 are each knit materials and illustrative embodiments of the invention. Engagement covers C1 and C2 are each conventional engagement covers used on transport rolls in accordance with the prior art.

TABLE 2

| Engagement Covers | | | | | |
|---|---|---|---|---|---|
| Engagement | | Composition | | Terry Loop | Monofilament |
| Cover | Knit/Stitch | Loop | Base | Height (mm) | Diameter (mm) |
| 1 | Warp Knit Full Tricot | Silicone | Silicone | NA | 1.0 |
| 2 | Warp Knit Full Tricot | FEP | FEP | NA | 0.28 |
| 3 | Warp Knit, Chain Stitch, Diamond Repeat | Silicone | Silicone | NA | 1.0 |
| 4 | Full Pile Terry | FEP | UHMWPE | 1.5 | 0.28 |
| 5 | Full Pile Terry | FEP | UHMWPE | 1.5 | 0.20 |
| 6 | Semi-Pile Terry | FEP | 150D PE | 1.5 | 0.28 |
| 7 | Semi-Pile Terry | FEP | 70D PE | 1.5 | 0.28 |
| 8 | Semi-Pile Terry | FEP | 150D PE | 2.7 | 0.28 |
| 9 | Semi-Pile Terry | FEP | 70D PE | 2.7 | 0.28 |
| 10 | Full Pile Terry | 150D PE | 150D PE | 1.5 | NA |
| 11 | Full Pile Terry | 400D PTFE | 400D PTFE | 1.5 | NA |
| C1 | NA | NA | NA | NA | NA |
| C2 | NA | NA | NA | NA | NA |

Full pile terry had a filament loop with every needle whereas semi-pile terry only had a filament loop at every other needle.

Experimental Apparatus and Method: The experiments were carried out using an Imass™ TL-2300 Slip/Peel Tester with a conveying apparatus attached thereto to create an interaction between an adhesive-coated workpiece and transport rollers.

Figure 11:
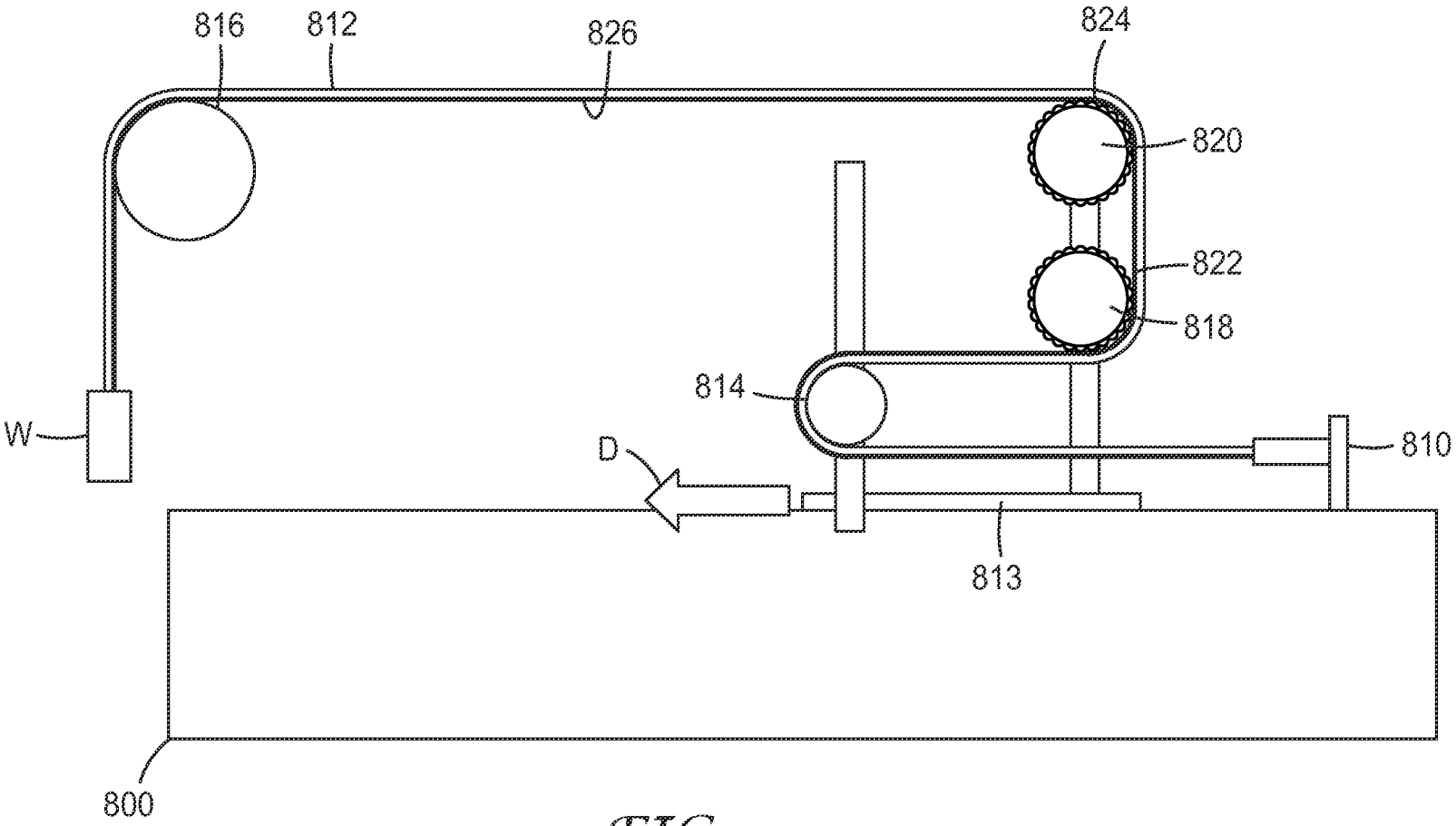
FIG. 11 is a schematic diagram of the apparatus used in the Examples.

As shown in FIG. 11, the apparatus 800 comprised a load cell 810 to which a flexible polyester strip 812 was attached and a drive screw driven platen 813 on which idler roll 814 and transport rolls 818 and 820 were mounted; idler roll 816 was mounted to the test body 800 and did not move with platen 813 and the other rolls. Strip 812 was wound around idler rolls 814 and 816. Intermediate to idler rolls 814 and 816 strip 812 was wound around two test transport rolls 818 and 820 which were each equipped with an engagement cover 822 and 824, respectively, as indicated below. A 5 centimeter (2 inch) wide adhesive tape 826 was mounted on one side of strip 812 to serve as a workpiece during the experiment with the adhesive face of the tape in passing configuration with each of engagement covers 822 and 824 on transport rolls 818 and 820, respectively. Only the bare opposing side of strip 812 contacted idler rolls 814 and 816.

Rolls 814, 816, 818, and 820 were each 10 centimeter (4 inch) diameter aluminum rolls. The passing apparatus was configured such that the workpiece 826 passed through about a 90° wrap (angle ⊖ in FIG. 5) with each engagement cover). A weight W, having a mass of 4.4kilogram (2 pound), was attached to the end of strip 812 to impart line tension in the strip and workpiece 826 develop engaging contact of the adhesive face of workpiece 826 with each of engagement covers 822 and 824. Upon activation, platen 813 was driven in direction D to pull a length of strip 812 and workpiece 826 and convey a length of workpiece 826 past rolls 814, 816, 818, and 820.

For each tape, three tests were run, each at a rate of 30 centimeters (12 inches) per minute for a test period of 20 seconds. The measured peel force, representing the interaction between engagement covers and the adhesive on the workpieces was measured and is reported in the following tables.

TABLE 3

Results with Workpiece 1: 3M ® Vinyl 471

| Engagement | Transport Force (grams$_f$) | | | | | | | |
|---|---|---|---|---|---|---|---|---|
| | Test 1 | | Test 2 | | Test 3 | | 3 Test Average | |
| Cover | Force | RMS | Force | RMS | Force | RMS | Force | RMS |
| 1 | 20.4 | 11.7 | 16.4 | 9.1 | 8.9 | 7.4 | 15.23 | 9.40 |
| 2 | 27.3 | 10.9 | 25.2 | 8.4 | 24.2 | 7.6 | 25.57 | 8.97 |
| 3 | 37.7 | 11.3 | 37.4 | 10.6 | 40.7 | 11.6 | 38.60 | 11.17 |
| 4 | 31.3 | 9.8 | 35.2 | 8.2 | 34.7 | 7.1 | 33.73 | 8.37 |
| 5 | 31.5 | 9.7 | 27.4 | 7.4 | 23.6 | 7.2 | 27.50 | 8.10 |
| 6 | 38.6 | 8.9 | 41.7 | 7.8 | 38.5 | 6.4 | 39.60 | 7.70 |
| 7 | 22.8 | 8.6 | 21.4 | 8.1 | 25.7 | 7.1 | 23.30 | 7.93 |
| 8 | 22.9 | 8.9 | 19.8 | 7.7 | 22.3 | 6.9 | 21.67 | 7.83 |
| 9 | 25.6 | 8.6 | 27.7 | 7.6 | 29.5 | 7.2 | 27.60 | 7.80 |
| 10 | 68.9 | 11.7 | 62.5 | 11.5 | 59.6 | 10.8 | 63.67 | 11.33 |
| 11 | 41.2 | 10.8 | 28.4 | 7.2 | 27.9 | 7.3 | 32.50 | 8.43 |
| C1 | 15.2 | 8.6 | 24.8 | 8.8 | 20.7 | 6.5 | 20.23 | 7.97 |
| C2 | 629.5 | 58.9 | 679.1 | 35.1 | 673.6 | 45.6 | 660.73 | 46.53 |

TABLE 4

Results with Workpiece 2: Scotch ® Packaging Tape 3750

| Engage- | Transport Force (grams$_f$) | | | | | | | |
|---|---|---|---|---|---|---|---|---|
| ment | Test 1 | | Test 2 | | Test 3 | | 3 Test Average | |
| Cover | Force | RMS | Force | RMS | Force | RMS | Force | RMS |
| 1 | 7.4 | 14.6 | 9.1 | 12.6 | 11.6 | 9.9 | 9.37 | 12.37 |
| 2 | 16.5 | 12.2 | 8 | 11 | 8.5 | 10.4 | 11.00 | 11.20 |
| 3 | 11.3 | 12.6 | 29.2 | 11.9 | 17.8 | 11.9 | 19.43 | 12.13 |
| 4 | 21.2 | 13.4 | 17.8 | 12.7 | 15 | 10.3 | 18.00 | 12.13 |
| 5 | 14.6 | 12 | 11.1 | 10.4 | 13.8 | 9.8 | 13.17 | 10.73 |
| 6 | 30.6 | 11.3 | 28.5 | 11 | 30.2 | 11 | 29.77 | 11.10 |
| 7 | 20.8 | 10.7 | 26.7 | 11.5 | 27.8 | 10.7 | 25.10 | 10.97 |
| 8 | 13.8 | 12.2 | 11 | 11.5 | 12.6 | 10 | 12.47 | 11.23 |
| 9 | 16.5 | 11.5 | 16.1 | 11.7 | 21.7 | 10.9 | 18.10 | 11.37 |
| 10 | 41.5 | 11.9 | 45.6 | 11.6 | 34 | 10.3 | 40.37 | 11.27 |
| 11 | 30.7 | 11 | 26.9 | 10 | 30.5 | 8.9 | 29.37 | 9.97 |
| C1 | 7.4 | 12 | 10.3 | 10 | 11.8 | 8.9 | 9.83 | 10.30 |
| C2 | 209.2 | 114.7 | 310.8 | 118.6 | 330.5 | 144.7 | 283.50 | 126.00 |

TABLE 5

Results with Workpiece 3: Scotch ® Filament Tape 893

| Engage- | Transport Force (grams$_f$) | | | | | | | |
|---|---|---|---|---|---|---|---|---|
| ment | Test 1 | | Test 2 | | Test 3 | | 3 Test Average | |
| Cover | Force | RMS | Force | RMS | Force | RMS | Force | RMS |
| 1 | 12.7 | 17.1 | 21.9 | 18.6 | 13.3 | 17.7 | 15.97 | 17.80 |
| 2 | 15.1 | 23 | 8.7 | 19.8 | 13 | 20.7 | 12.27 | 21.17 |
| 3 | 31.3 | 14 | 26.4 | 14 | 36 | 13.4 | 31.23 | 13.80 |

TABLE 5-continued

Results with Workpiece 3: Scotch ® Filament Tape 893

| Engage- | Transport Force (grams$_f$) | | | | | | | |
|---|---|---|---|---|---|---|---|---|
| ment | Test 1 | | Test 2 | | Test 3 | | 3 Test Average | |
| Cover | Force | RMS | Force | RMS | Force | RMS | Force | RMS |
| 4 | 31 | 17.7 | 28.2 | 17 | 33 | 16.3 | 30.73 | 17.00 |
| 5 | 54.8 | 16.8 | 41.6 | 16.9 | 52.2 | 14.6 | 49.53 | 16.10 |
| 6 | 50.4 | 17.3 | 57.6 | 17 | 62.8 | 17.7 | 56.93 | 17.33 |
| 7 | 36 | 17.4 | 35.8 | 17.3 | 40.7 | 16.5 | 37.50 | 17.07 |
| 8 | 38.1 | 16.5 | 45.6 | 14.3 | 50.4 | 14.7 | 44.70 | 15.17 |
| 9 | 32.6 | 15.7 | 37.1 | 14.9 | 38.2 | 15.5 | 35.97 | 15.37 |
| 10 | 23.1 | 18.5 | 20.2 | 16 | 18.8 | 13.8 | 20.70 | 16.10 |
| 11 | 66.9 | 19.4 | 49.8 | 14.5 | 46.6 | 13.5 | 54.43 | 15.80 |
| C1 | 10.1 | 15.1 | 18.2 | 14.7 | 13 | 14.8 | 13.77 | 14.87 |
| C2 | 366 | 349.8 | Test Failure* | | | | 366.00 | 349.80 |

*The engagement cover, in essence a film of material, did not undergo a smooth engaging contact with the workpiece, instead the workpiece advanced in a pattern of alternating snatches or seizures and fast advance, thereby exposing the workpiece to a damaging degree of disruptive stresses.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An apparatus for conveying a workpiece having a major surface with exposed adhesive, the apparatus comprising a transport roll comprising a core and an engagement cover having an engagement surface comprising looped filaments that have a surface energy of less than about 30 dynes/centimeter$^2$.

2. A method for conveying a workpiece having a major surface with exposed adhesive, the method comprising:

(a) providing a workpiece having a first major surface having exposed pressure sensitive adhesive thereon;

(b) providing at least one transport roll having an engagement cover having an engagement surface comprising looped filaments that have a surface energy of less than about 30 dynes/centimeter$^2$;

(c) configuring the workpiece into passing configuration to the transport roll; and (d) passing the workpiece through engaging contact with the engagement surface such that at least a portion of the pressure sensitive adhesive of the first major surface of the workpiece directly contacts the engagement surface wherein the pressure sensitive adhesive is tacky when in contact with the engagement surface.

3. The method of claim 2 wherein the engagement cover is a knit material.

4. The method of claim 3 wherein the knit is selected from the group of warp knits and weft knits.

5. The method of claim 3 wherein the engagement cover is selected from the group of terry loop knits and French cross knits.

6. The method of claim 2 wherein the engagement cover is a removable sleeve on the roll.

7. The method of claim 2 wherein the engagement cover comprises monofilament yarn.

8. The method of claim 7 wherein the engagement cover consists essentially of monofilament yarn.

9. The method of claim 8 wherein the monofilament yarn has an average diameter of from about 725 to about 1530 micrometers (about 3 to about 50 mils).

10. The method of claim 8 wherein the monofilament yarn has an average diameter of from about 125 to about 510 micrometers (about 5 to about 20 mils).

11. The method of claim 8 wherein the average diameter of the monofilament yarn is at least about 1.2 times the thickness of the pressure sensitive adhesive.

12. The method of claim 11 wherein the average diameter of the yarn is about 2 to about 30 times the thickness of the pressure sensitive adhesive.

13. The method of claim 3 wherein the knit has an average thread count in the range of from about 6 to about 12 needles/centimeter (about 15 to about 30 needles/inch).

14. The method of claim 13 wherein the knit has an average thread count in the range of from about 8 to about 11 needles/centimeter (about 20 to about 28 needles/inch).

15. The method of claim 3 wherein the loops in the knit material have a radial spacing of from about 1000 to about 1250 micrometers (about 40 to about 50 mils).

16. The method of claim 3 wherein the loops in the knit material have an axial spacing of from about 1140 to about 1400 micrometers (about 45 to about 55 mils).

17. The method of claim 3 wherein the knit material comprises yarn selected from the group consisting of silicones and fluoroethylene polypropylenes.

18. The method of claim 2 wherein the looped filaments have a surface energy of from about 8 to about 25 dynes/centimeter$^2$.

19. The method of claim 2 wherein the workpiece is a web material.

20. The method of claim 19 wherein the web material is provided in roll form and configuring the web material into passing configuration comprises unrolling the web material.

21. The method of claim 19 wherein the web material is extruded or cast in line to be configured into the passing configuration without having been wound into roll form.

22. The method of claim 19 wherein the web material is provided in sheet form.

23. The method of claim 2 wherein the workpiece has a second major surface having exposed pressure sensitive adhesive thereon.

24. The method of claim 23 further comprising:

(e) providing a second one transport roll having an engagement cover having an engagement surface comprising looped filaments that have a surface energy of less than about 30 dynes/centimeter$^2$;

(f) configuring the workpiece into passing configuration to the second transport roll; and (g) passing the workpiece through engaging contact with the engagement surface of the second transport roll such that at least a portion of the pressure sensitive adhesive of the second major surface of the workpiece directly contacts the engagement surface of the second transport roll wherein the pressure sensitive adhesive is tacky when in contact with the engagement surface.

25. The method of claim 2 wherein the transport roll is selected from the group consisting of idler rolls and driven rolls.

26. The method of claim 2 comprising providing two or more transport rolls each having such an engagement cover and passing the web through engaging contact with the engagement surface of each transport roll such that the pressure sensitive adhesive directly contacts the engagement surface.

* * * * *